US008453870B2

(12) United States Patent
Berg

(10) Patent No.: US 8,453,870 B2
(45) Date of Patent: Jun. 4, 2013

(54) DRINKING CUP DEVICE

(76) Inventors: Gunnar Berg, Kristiansand (NO); Anne May Berg, legal representative, Kristiansand (NO); Heidi Berg, legal representative, Kristiansand (NO)

( * ) Notice: Subject to any disclaimer, the term of this patent is extended or adjusted under 35 U.S.C. 154(b) by 229 days.

(21) Appl. No.: 12/920,019

(22) PCT Filed: Mar. 30, 2009

(86) PCT No.: PCT/NO2009/000118

§ 371 (c)(1),
(2), (4) Date: Dec. 8, 2010

(87) PCT Pub. No.: WO2009/126042

PCT Pub. Date: Oct. 15, 2009

(65) Prior Publication Data

US 2011/0084084 A1 Apr. 14, 2011

(30) Foreign Application Priority Data

Apr. 7, 2008 (NO) ..... 20081717

(51) Int. Cl.
*B65D 25/48* (2006.01)
*B65D 47/12* (2006.01)
*A47G 19/22* (2006.01)

(52) U.S. Cl.
USPC ..... 220/703; 220/713; 220/714; 220/718; 220/719; 220/366.1; 220/254.7; 220/731; 220/369; 220/253; 222/517; 222/518; 222/571; 222/485; 222/490; 222/484; 215/311

(58) Field of Classification Search
USPC ..... 220/253, 711, 380, 713, 714, 718, 220/719, 254, 90.4, 366, 731, 369, 703; 222/485, 490, 484, 517, 518, 571; 215/11.4, 215/11.5, 311, 315; 119/61.54, 61.55
See application file for complete search history.

(56) References Cited

U.S. PATENT DOCUMENTS

| | | | | | |
|---|---|---|---|---|---|
| 1,254,251 | A | * | 1/1918 | Magnus | 220/719 |
| 2,414,697 | A | * | 1/1947 | Pettersson | 220/713 |
| 2,623,368 | A | * | 12/1952 | Olsen | 220/711 |
| 3,338,467 | A | * | 8/1967 | Albert | 220/714 |
| 3,360,160 | A | * | 12/1967 | Spencer | 220/719 |
| 3,360,161 | A | * | 12/1967 | Smith | 220/719 |
| 3,549,044 | A | * | 12/1970 | Lerner | 220/719 |
| 3,727,808 | A | * | 4/1973 | Fitzgerald | 222/482 |
| 3,797,696 | A | * | 3/1974 | Dibrell | 220/714 |
| 3,915,331 | A | * | 10/1975 | Chenault | 220/711 |
| 4,130,215 | A | * | 12/1978 | Corey et al. | 220/719 |
| 4,184,603 | A | * | 1/1980 | Hamilton, Sr. | 220/254.9 |

(Continued)

FOREIGN PATENT DOCUMENTS

| | | |
|---|---|---|
| WO | WO 00/48491 | 8/2000 |
| WO | WO 02/11587 A1 | 2/2002 |
| WO | WO 03/061438 A1 | 7/2003 |

*Primary Examiner* — Mickey Yu
*Assistant Examiner* — Gideon Weinerth
(74) *Attorney, Agent, or Firm* — GableGotwals

(57) ABSTRACT

A device by a drinking cup (1) comprising a container (2) and a valve element (4), the valve element (4) being provided with, on at least a portion of its free edge portion (12), an abutment (14) for a sealing, actuable gasket (8), and wherein a user's lip is resting against the gasket (8) when the drinking cup (1) is in its operating position.

5 Claims, 6 Drawing Sheets

U.S. PATENT DOCUMENTS

| | | | | |
|---|---|---|---|---|
| 4,238,045 | A * | 12/1980 | D'Andria | 220/714 |
| 5,370,258 | A * | 12/1994 | Fair | 220/719 |
| 5,540,350 | A * | 7/1996 | Lansky | 220/380 |
| 5,890,619 | A * | 4/1999 | Belanger | 220/713 |
| 6,102,244 | A * | 8/2000 | Kuwano et al. | 220/713 |
| 6,176,399 | B1 * | 1/2001 | Schantz et al. | 222/484 |
| 6,202,877 | B1 * | 3/2001 | La Torre et al. | 220/254.1 |
| 6,325,236 | B1 * | 12/2001 | Wong | 220/713 |
| 6,702,145 | B2 * | 3/2004 | Malcolm | 220/713 |
| 7,168,589 | B2 * | 1/2007 | Dark | 220/711 |
| 7,549,556 | B2 * | 6/2009 | Miller | 220/714 |
| 7,712,622 | B2 * | 5/2010 | Ruccolo | 220/23.87 |
| 8,033,420 | B2 * | 10/2011 | Roseblade et al. | 220/731 |
| 8,191,728 | B2 * | 6/2012 | Auer et al. | 220/784 |
| 8,333,299 | B2 * | 12/2012 | Kemper et al. | 220/719 |
| 2005/0224495 | A1 * | 10/2005 | Kartinian | 220/253 |
| 2006/0169694 | A1 * | 8/2006 | Kemper | 220/303 |

* cited by examiner

DRINKING CUP DEVICE

CROSS REFERENCE TO RELATED APPLICATIONS

This application is the US National Phase of PCT Application No. NO2009/000118 filed 30 Mar. 2009, which was published in English on 15 Oct. 2009 under No. WO2009/126042A1, which claims priority to Norwegian Patent Application No. 20081717 filed 7 Apr. 2008, all of which are incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A SEQUENCE LISTING

Not Applicable

BACKGROUND OF THE INVENTION

1) Field of the Invention

A drinking cup device is provided. More specifically, the present invention relates to a drinking cup comprising a container and a valve element, the valve element being provided with, on at least in a portion of its free edge portion, a mechanism for a sealing, actuable gasket.

In this context a drinking cup means a cup, a vessel or a glass, that is equipped with a remedy for avoiding or reduction of the risk of spilling.

2) Description of Related Art

Young children and the elderly may find it difficult to drink from ordinary cups without spilling. This might be due to a lack of control over the cup or reduced mobility.

It is known that cups which are provided with a drinking spout can provide considerable help. It is also known to provide the cup with a valve in order to prevent liquid from flowing out if the cup tips.

Thus, WO 00/48491 discloses a drinking cup where the spout of the cup is equipped with a valve element. The valve is activated by pulling a sealing elastic cover away from the valve element by means of underpressure, thereby opening the valve.

Adults might be uncomfortable using a drinking cup with a spout, since this is indicating reduced mobility to the surroundings.

Drinking cups provided with openings along the periphery of the cover are also known. Thus, U.S. Pat. No. 5,890,619 discloses a drinking cup with a relatively large number of openings being arranged along the circumference for the lid. The drinking cup is provided with a suction actuable valve inside the lid.

WO 03/061438 relates to a drinking cup where an aperture is arranged along the circumference of the lid, between an outer member and an inner member. A cylindrical sealing element, placed between the two members, is actuable by suction by being lifted off the abutment against the first member. A drinking cup according to this document has inadequate functionality.

BRIEF SUMMARY OF THE INVENTION

The object of the invention is to remedy or to reduce at least one of the disadvantages of the prior art.

A drinking cup is provided which comprises a container and a valve element, the valve element being provided with, on at least a portion of its free edge portion, an abutment for a sealing, actuable gasket, the drinking cup being characterized in that a user's lip abuts the gasket when the drinking cup is in an operating position.

The meaning of "operating position" in this context is the position of the drinking cup when a user is drinking from the drinking cup.

One aspect of the drinking cup is that the gasket is displaceable from the abutment. In its sealing position the gasket rests partly pretensioned against the abutment. The pretension usually occurs by a partial deformation of the gasket when it is installed on the valve element.

Another aspect of the drinking cup is that the gasket is designed to be displaced from the structure by the application of external suction from outside the gasket. The suction is created by a user placing his or her lips against the gasket and sucking liquid from the cup.

Still another aspect of the drinking cup is that the gasket is arranged to be displaced from the abutment through deformation being applied to the gasket from the outside of the gasket. A user's lip will, for example, press a portion of the gasket inward creating a leverage effect, causing another portion of the gasket being displaced outwardly from the abutment.

Still another aspect of the drinking cup is that the gasket is constituting a lid over at least the valve element or the container. Thus, the gasket will cover the upper portion of the drinking cup.

Still another aspect of the drinking cup is that the elastic gasket is connected to the valve element by a fastening groove. Thus, the gasket can easily be removed from and fitted to the drinking cup, for example when cleaning or filling the drinking cup.

Still another aspect of the drinking cup is that the valve element comprises a splash guard provided with through openings. The splash guard has proved to be advantageous by being designed to suppress the mass forces from the liquid in the container, for example if the drinking cup tips or is shaken. The openings can be shielded.

The provided drinking cup has proved to overcome several of the deficiencies of prior art drinking cups. The drinking cup comprises relatively few components and is therefore fairly easy to keep clean, inexpensive to produce and simple to use.

BRIEF DESCRIPTION OF THE DRAWINGS

An example of a preferred embodiment is described in the following and is depicted in the accompanying drawings, in which.

DETAILED DESCRIPTION OF THE INVENTION

Figure 1:
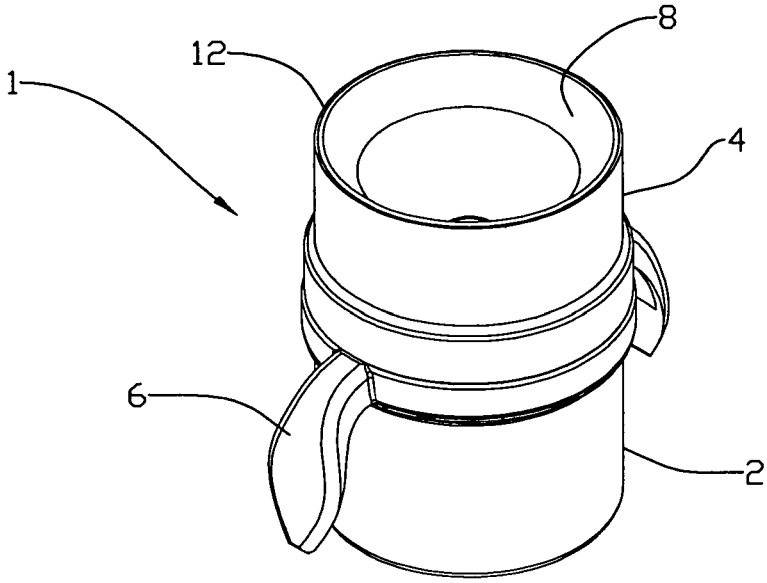
FIG. 1 shows a perspective view of the drinking cup.

In the figures, reference numeral 1 is a drinking cup comprising a container 2 and a valve element 4. The drinking cup 1 is provided with handles 6. A gasket 8 is arranged to prevent liquid from unintentionally pouring out of the drinking cup 1. In this embodiment, the valve element 4 constitutes a removable part of the container 2. When in use, a user's lip is resting against the gasket 8.

Figure 2:
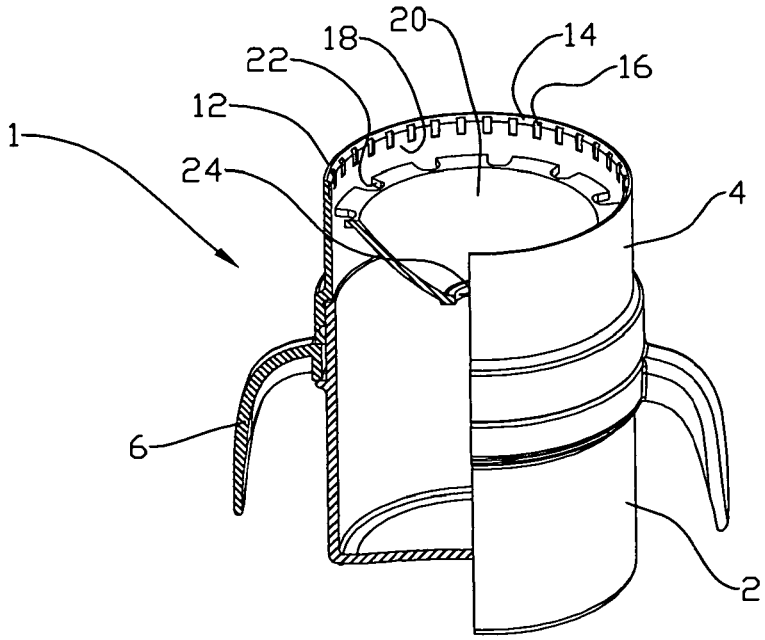
FIG. 2 shows a partial sectional view of the drinking cup in FIG. 1 where the gasket of the drinking cup has been removed.
Figure 3:
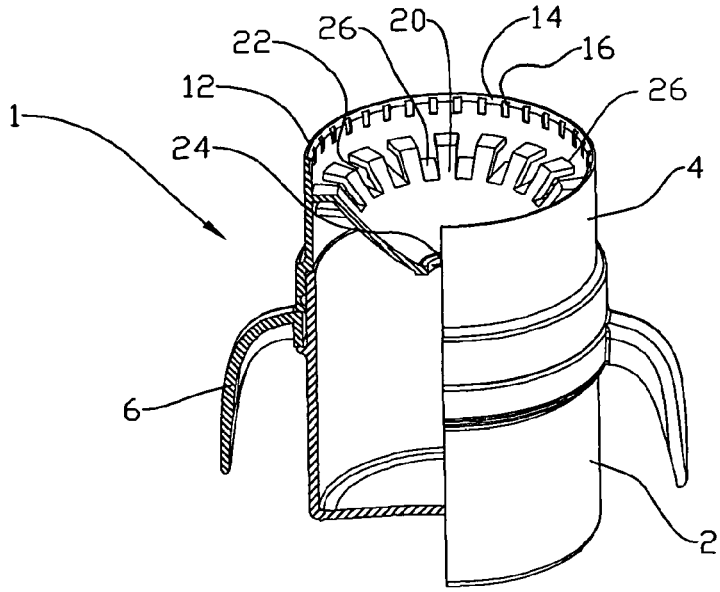
FIG. 3 shows a partial sectional view of the drinking cup in FIG. 1 where the gasket of the drinking cup has been removed and where the splash guard for the drinking cup has an alternative design.
Figure 4:
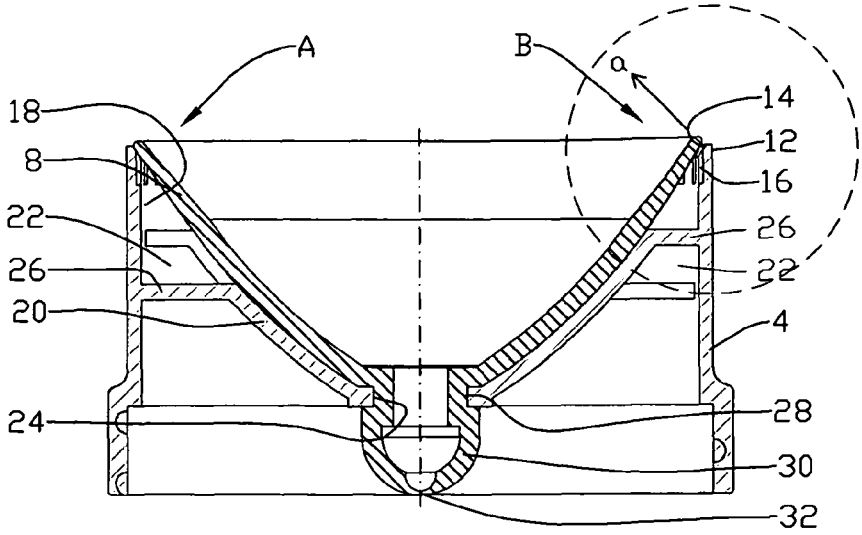
FIG. 4 shows a cross-sectional view on a larger scale of the valve in FIG. 3 also showing the gasket.
Figure 4B:
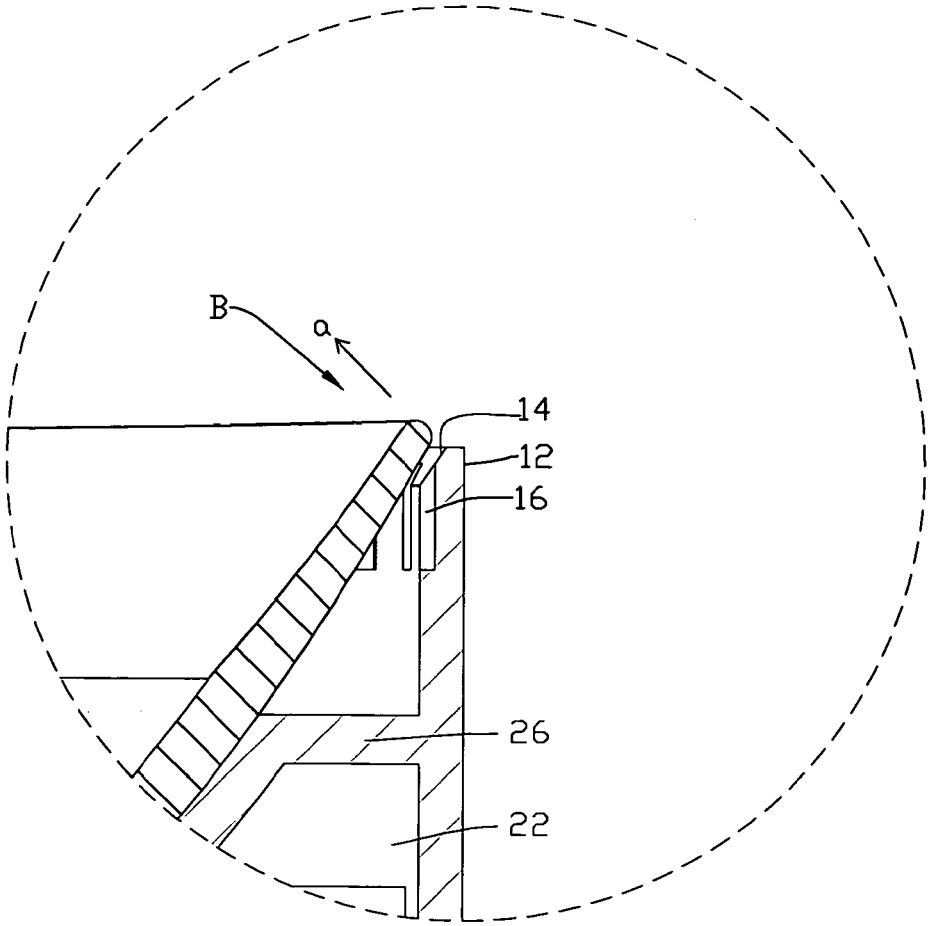

The valve element 4 is, along its free edge portion 12, provided with an abutment 14 in the form of a conical surface, see FIGS. 2, 3 and 4. The gasket 8 is designed to lie sealingly against the abutment 14. A number of evenly spaced indentations 16 on the inner cylindrical surface 18 of the valve element end in the abutment 14.

The valve element 4 is further provided with a splash guard 20 with through-openings 22. The splash guard 20 is also provided with a centric through-fastening opening 24 for the gasket 8. The splash guard 20 is designed to reduce the mass forces exerted on the gasket 8 from the liquid in the drinking cup 1, for example if the drinking cup 1 is shaken.

In FIGS. 3 and 4, the openings 22 in the splash guard 20 are shielded by respective covers 26 that are located at a certain distance from their respective openings 22.

The gasket 8, which is designed from an elastic, rubberlike material, is provided with a surrounding fastening groove 28, which complementary fits into the fastening opening 24 in the splash guard 20. The gasket is fitted onto the valve element 4 by displacing the mid-section 30 of the gasket 8 into the fastening opening 24 until the fastening groove 28 grips the material around the fastening opening 24. The mid-section 30 is designed with a relatively small vent 32.

Detail A in FIG. 4 shows the gasket 8 laying sealingly against the abutment 14, the shape of the gasket 8 causing it to lay slightly pretensioned against the abutment 14. Detail B in FIG. 4 shows the gasket 8, a portion of the gasket 8, due to external suction, being displaced slightly off the abutment 14, the suction being depicted by force arrow "a". The distance between the gasket 8 and the abutment 14 in detail B allows liquid to flow through the opening 22, the indentations 16 and out between the gasket and the abutment 14.

When the underpressure against the outside of the gasket 8 is removed, the gasket 8 will again lay sealingly against the abutment 14.

Figure 5:
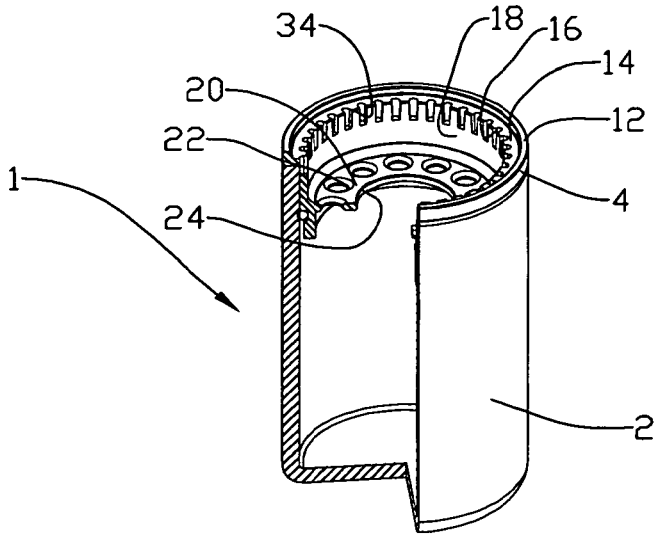
FIG. 5 shows a partial cross-sectional perspective view of a drinking cup in an alternate embodiment, where the gasket for the drinking cup is removed.
Figure 6:
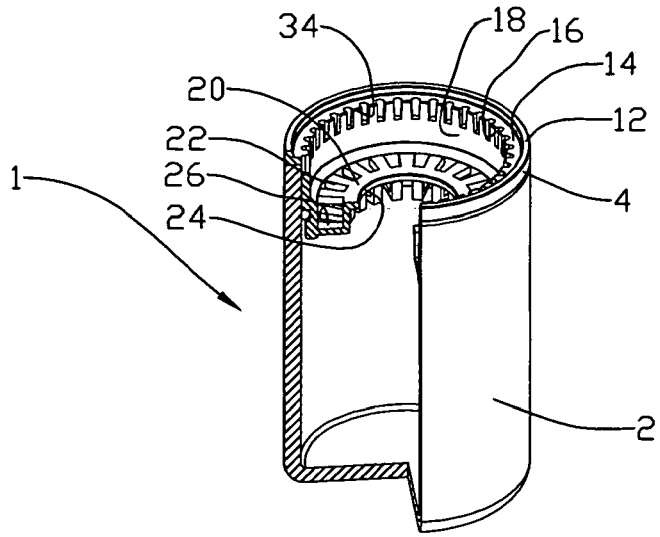
FIG. 6 shows the same illustration as FIG. 5, but where the splash guard is designed in the same manner as in FIG. 3.
Figure 7:
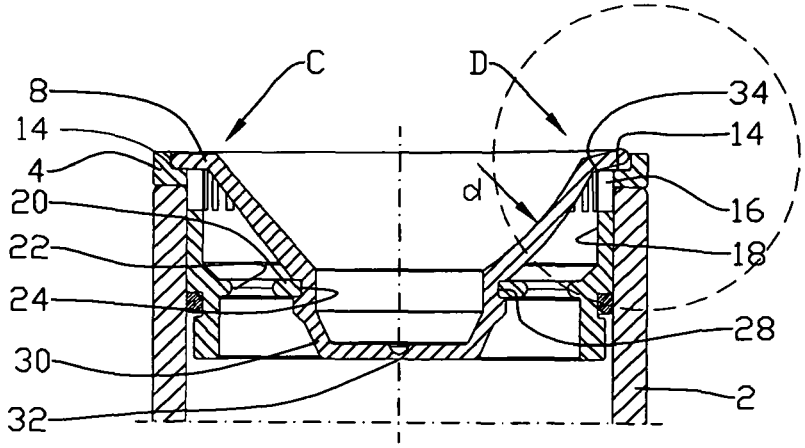
FIG. 7 shows a cross-sectional view on a larger scale of the valve in FIG. 5, also showing the gasket.

In one alternative, and somewhat simplified, embodiment, the valve element 4 is substantially positioned inside the container 2; see FIGS. 5, 6 and 7.

Similarly to the exemplary embodiments presented above, the drinking cup 1, in FIG. 6, is also designed with a splash guard 20, the openings 22 being shielded by covers 26.

Detail C in FIG. 7 shows the gasket resting against the abutment 14, which in this embodiment consists of a flange-like radial surface.

When a force is applied to the gasket 8, such as is indicated by an arrow d in detail D in FIG. 7, a portion of the gasket 8 tilts around the inner edge portion 34 of the abutment 14 and outwardly from the abutment 14. Thus, liquid can flow from the container 2 through the openings 22, the indentations 16 and out between the gasket 8 and the abutment 14.

Figure 8:
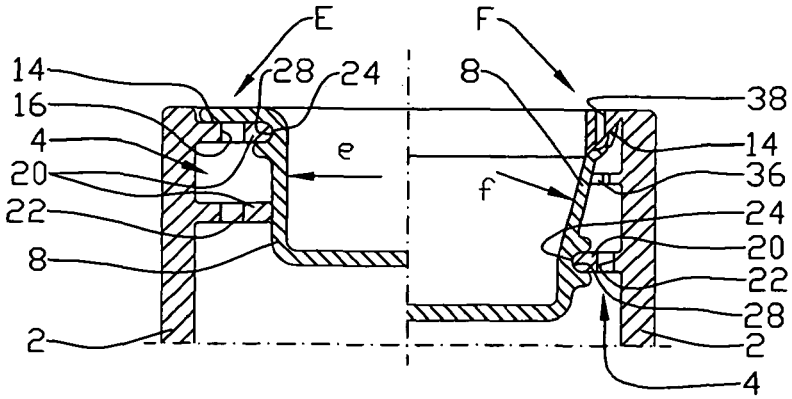
FIG. 8 shows an alternative embodiment of the valve element for the drinking cup, on a larger scale.
Figure 7D:
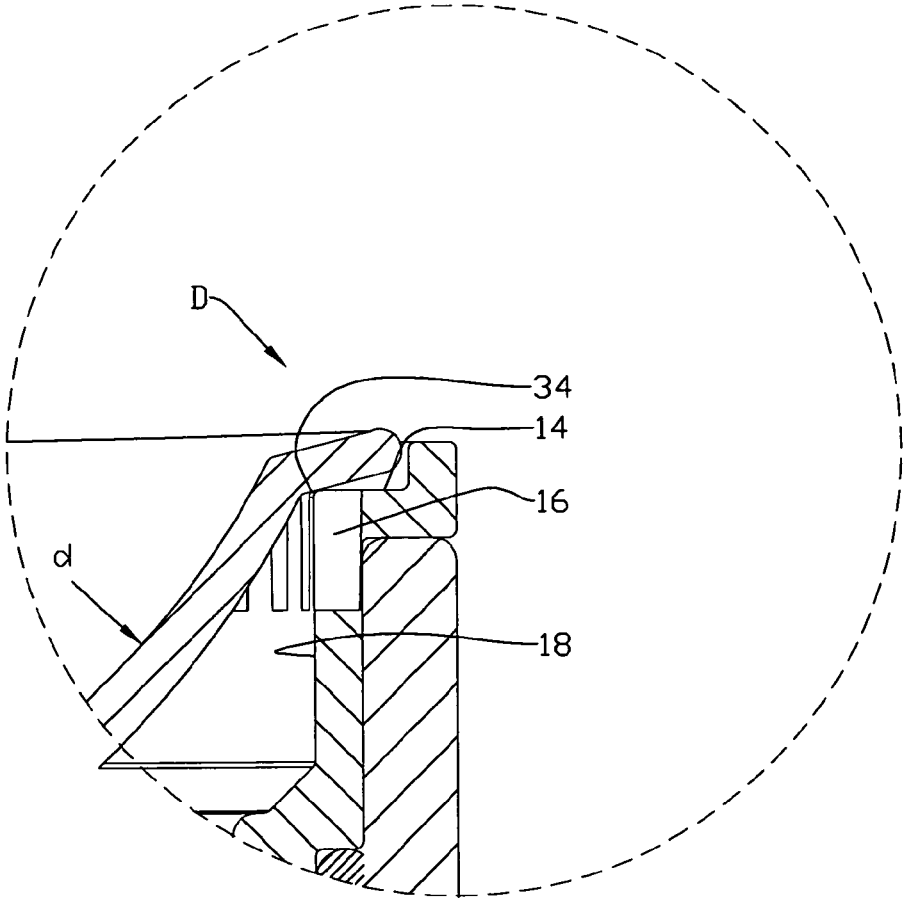
FIG. 7D shows a detail of the region identified in FIG. 7.

FIG. 8 shows two additional, simplified, exemplary embodiments, where the valve element 4 constitutes a portion of the container 2. Detail E shows an embodiment where the gasket 8 is positioned to be displaced outwardly from the abutment 14 by an external underpressure and/or through a force applied from the outside, as indicated by arrow e.

In detail F, the gasket 8 rests against the abutment 14 such that the abutment 14 faces inward towards the container 2. An outside force, here indicated by arrow f, will deform the gasket 8, by tilting a portion of the gasket 8 around an edge portion of a support ring 36, sufficiently to allow a liquid flow between the gasket 8 and the abutment 14 and further out through borings 38.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

The invention claimed is:

1. A drinking cup comprising:

a container having a cylindrical inner, upper surface;

an abutment surface arranged along an upper edge of the cylindrical inner, upper surface;

a plurality of channels or indentations arranged in the abutment surface;

a splash guard member in the form of a disc element arranged in the interior of the container, the splash guard comprising an opening in its center for receiving an engagement portion of an actuating gasket, and further comprising passages along its periphery for permitting a flow of a liquid;

and a gasket;

wherein the gasket, when engaged with the splash guard, has an edge portion arranged to sealingly rest against the abutment surface such that the channels or indentations are covered by the gasket; and further wherein the edge of the gasket is arranged to lift, in response to a suction force generated by the mouth of a user, from the abutment surface such that one or more of the channels or indentations is at least partially exposed to form a fluid communication between the interior of the upper edge and the exterior, thus allowing a liquid to flow through the channels or indentations into the mouth of the user.

2. A drinking cup according to claim 1, wherein the abutment surface has an inner edge portion arranged to function as a fulcrum, and wherein an outer portion of the gasket is arranged to rotate about said edge and thereby lift the edge of the gasket from the abutment surface in repose to pressure applied by the lips of the user to an inner portion of the gasket.

3. A drinking cup according to claim 1, further comprising a ridge arranged along the cylindrical inner, upper surface, beneath the abutment surface, the edge of said ridge arranged to function as a fulcrum, and wherein an outer portion of the gasket is arranged to rotate about said edge and thereby lift the edge of the gasket from the abutment surface in repose to pressure applied by the lips of the user to an inner portion of the gasket.

4. A drinking cup according claim 1, wherein the cylindrical inner, upper surface, the abutment surface, the splash guard member and the gasket comprise part of a removable valve element.

5. A drinking cup according to claim 4 wherein the splash guard further comprises covers arranged above the passages.

* * * * *